US008820390B2

(12) United States Patent
Cintron-Aponte et al.

(10) Patent No.: US 8,820,390 B2
(45) Date of Patent: Sep. 2, 2014

(54) METHODS AND COMPOSITION FOR BORIDE DISTRIBUTION IN METAL MATRIX COMPOSITE

(75) Inventors: Alexandra Cintron-Aponte, St. Petersburg, FL (US); Jose R. Vazquez, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 13/405,131

(22) Filed: Feb. 24, 2012

(65) Prior Publication Data

US 2012/0216980 A1 Aug. 30, 2012

Related U.S. Application Data

(60) Provisional application No. 61/446,772, filed on Feb. 25, 2011.

(51) Int. Cl.
*B22D 27/04* (2006.01)

(52) U.S. Cl.
USPC ..... 164/122.1; 164/127; 164/97

(58) Field of Classification Search
USPC ..... 164/97, 122, 122.1, 125–128, 122.2, 164/114–118, 286–301
See application file for complete search history.

(56) References Cited

U.S. PATENT DOCUMENTS

| | | | | |
|---|---|---|---|---|
| 6,250,364 | B1 * | 6/2001 | Chung et al. | 164/97 |
| 6,499,529 | B1 * | 12/2002 | Farkas | 164/114 |
| 2005/0016706 | A1 * | 1/2005 | Ray et al. | 164/97 |
| 2010/0307838 | A1 * | 12/2010 | Stevens et al. | 175/374 |

OTHER PUBLICATIONS

"Gases, Liquids and Solids", http://www.chem.purdue.edu/gchelp/liquids/character.html, date unknown.*
Centrifugal Casting, http://www.custompartnet.com/wu/centrifugal-casting, Mar. 30, 2009.*

* cited by examiner

*Primary Examiner* — Keith Walker
*Assistant Examiner* — Kevin E Yoon

(57) ABSTRACT

A method for controlling a boride distribution in a metal matrix compost includes controlling a distribution of the boride particles are controlled during a solidification of a molten composite material. The controlling of the redistribution of the boride particles includes applying a heat to the composite material to form a molten composite material. The method includes, holding, by a mold (120, 715), the molten composite material. The method also includes focusing, by a reinforcement particle unit (100, 700), a location of the boride particles during a cooling of the molten composite material. The reinforcement particle unit could include a directed solidification unit (100). The reinforcement particle unit could also include centrifugal casting system (700). The arm includes a center mounting point (725).

20 Claims, 8 Drawing Sheets

METHODS AND COMPOSITION FOR BORIDE DISTRIBUTION IN METAL MATRIX COMPOSITE

CROSS-REFERENCE TO RELATED APPLICATION AND CLAIM OF PRIORITY

This application claims priority under 35 U.S.C. §119(e) to U.S. Provisional Patent Application No. 61/446,772 filed on Feb. 25, 2011, which is hereby incorporated by reference.

TECHNICAL FIELD

This disclosure is directed in general to metal matrix composites and, more particularly, to a method and composition for boride distribution in a metal matrix composite.

BACKGROUND OF THE DISCLOSURE

Aluminum matrix composites (AMCs) are becoming more relevant for machinery and structural applications because of their enhanced mechanical properties and low density. AMCs can also be produced as functionally graded materials. Parts can be enhanced with reinforcement particles only where needed, providing a designer the ability to produce optimum and more complex shapes without compromising a structural integrity of the composite.

SUMMARY OF THE DISCLOSURE

This disclosure provides a method for boride distribution in a metal matrix composite.

In a first embodiment, a method includes placing a molten composite material in a mold configured to hold the molten composite material. The method also includes redistributing, by a reinforcement particle unit reinforcement particles during a solidification of the molten composite material.

In a second embodiment, a method includes forming a composite material comprising a specified percentage of boride particles. The method also includes controlling a redistribution of the boride particles in the composite material during a solidification of the molten composite material. The controlling of the redistribution of the boride particles includes applying a heat to the composite material to form a molten composite material; holding, in a mold, the molten composite material; and focusing, by a reinforcement particle unit, a location of the boride particles during a cooling of the molten composite material.

In a third embodiment, a method includes applying a first heat to a composite material to form a molten composite material. The method also includes holding the molten composite material in a mold during a solidification of the molten composite material and redistributing reinforcement particles during the solidification of the molten composite material.

Certain embodiments may provide various technical advantages depending on the implementation. For example, a technical advantage of some embodiments may include the capability to redistribute reinforcement particles in a composite alloy. A technical advantage of other embodiments may include the capability to delay a solidification of a molten composite alloy to effect a redistribution of the reinforcement particles. Another technical advantage may include the capability to apply a centrifugal force to the composite alloy to effect a redistribution of the reinforcement particles.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of this disclosure and its advantages, reference is now made to the following description taken in conjunction with the accompanying drawings, in which like reference numerals represent like parts.

DETAILED DESCRIPTION

Figure 1:
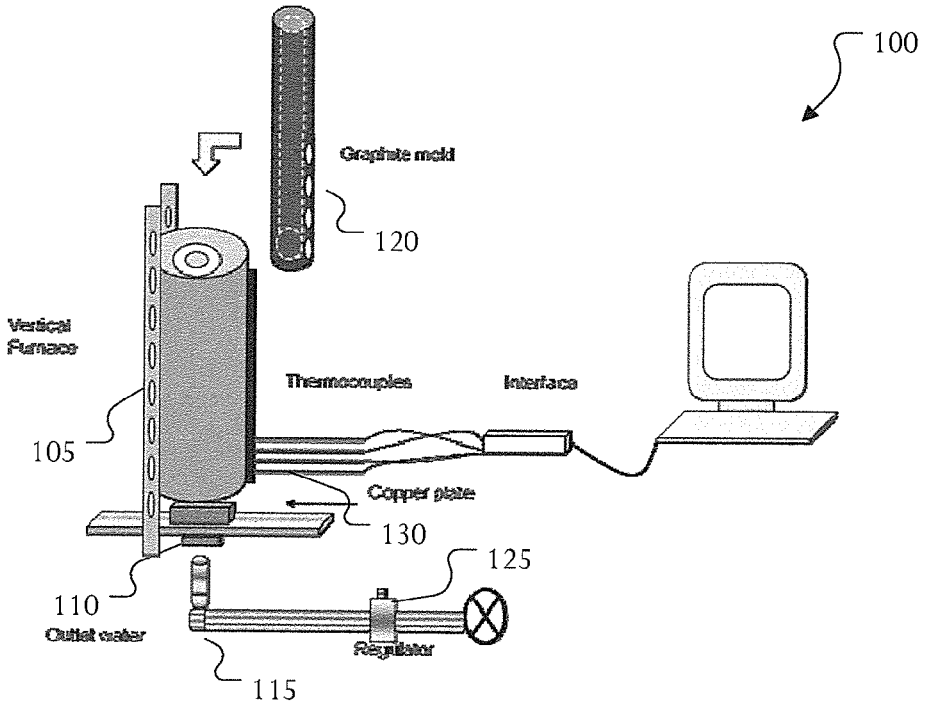
FIG. 1 illustrates a directional solidification system according to embodiments of this disclosure.

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

The design of cast metal-based composite materials may require numerous experiments to identify influential processing variables. Aluminum matrix composites (AMCs) can be produced as functionally graded materials. Manufacturers can enhance various parts using reinforcement particles. However, distribution of the reinforcement particles is random based on heat dissipation of the AMC.

Given such concerns, certain embodiments of the disclosure teach a system and method for manipulating diboride particles in various aluminum alloy-based composites. Additionally, in particular embodiments, the manufacturing process is configured to increase structural integrity, as compared to conventional manufacturing processes, through manipulation of reinforcing particle distribution. Certain embodiments of the disclosure also teach a manufacturing method to manipulate a concentration of the reinforcing particle distribution in the aluminum alloy-based composite.

Certain embodiments teach centrifugal and directional casting techniques configured to manipulate reinforcing particle distribution. Examples of the different casting techniques disclosed herein illustrate different alloying compositions and their respective particle reinforcements, such as aluminum-diboride ($AlB_2$). Examples of the different casting techniques further teach a reinforcement particle unit that controls the distribution of reinforcement particles throughout the castings to effect particle spacing, which is directly related to the dispersoids' volume fraction. The particle spacing further affects the composite's mechanical properties. Therefore, certain embodiments teach systems and methods configured to achieve uniform distribution of reinforcements throughout the matrix, which impacts the material quality. Certain embodiments teach processing parameters in melting and solidification on composites, such as in cast aluminum (Al) matrix composites, that affect particle distribution, which is useful in creating optimum mechanical properties. Parameters such as local heat transfer rates, changes in composition, and solidification front velocity (among others) regulate the viscosity of the solidifying composite and the segregation of the reinforcement.

Certain embodiments identify and utilize (apply, alter or adjust) influential processing variables to design a novel cast metal-based composite material. Embodiments of this disclosure illustrate the effect of diboride particles on various aluminum alloy-based composites, with a focus on the effect of the manufacturing route on the reinforcing particles distribution.

In particular embodiments, the distance between boride particles follows on a lognormal distribution in which the overall value of inter-particle spacing was seen between 5 and 7 micrometers (μm), with the highest ones being between 6-7 (μm). A small variation in the matrix chemical composition does not affect the measured inter-particle distances. A gravity casting process does not have a significant effect on the superficial hardness of the materials. Conversely, certain embodiments of this disclosure teach a centrifugal casting process that enhances the mechanical properties and superficial hardness of the composites, with or without boron (B), especially at higher rotational speed values; hardness increases proportionally to centrifugal speed. In an aluminum-boron-vanadium (Al—B—V) composite, superficial hardness increases with the boron content. In addition, certain embodiments of this disclosure teach a directional solidification casting process in which low hardness values are disposed at zones nearest a chill plate (e.g., heat sink) and higher superficial hardness values are disposed at regions furthest away from the chill plate.

FIG. 1 illustrates a directional solidification system 100 according to embodiments of this disclosure. The directional solidification system 100 of FIG. 1 is configured to cast a composite material, such as an AMC. Although certain details will be provided with reference to the components of the directional solidification system 100 of FIG. 1, it should be understood that other embodiments may include more, less, or different components. The directional solidification system 100 includes a furnace 105, a heat sink 110 and a cooling source 115.

The furnace 105 is adapted to receive a mold cast 120, such as a graphite mold cast. The furnace 105 provides heat to the mold cast 120 to inhibit a cooling of a molten metal contained within the mold cast 120. For example, the furnace 105 can provide a heat at 850° C. for an Al-1-5 wt % B-1-5 wt % Cu composite. It should be understood that illustration of a heat provided at 850° C. is exemplary, and other temperatures could be applied depending upon thermal characteristics of the molten composite. The furnace 105 can be a vertical furnace, such as an electrical vertical furnace, or any suitable furnace adapted to provide heat sufficient to hinder a cooling of the composite material. The heat sink 110 is disposed at one end of the furnace 105 proximate to the cooling source 115. For example, the heat sink 110 can be disposed at a bottom end of the vertical furnace 105. The heat sink 110 can be a copper plate or any suitable material configured to efficiently draw heat away from the mold cast 120.

Using the directional solidification system 100, reinforcement particles are added to a master alloy, such as aluminum-copper (Al—Cu), aluminum-silicon (Al—Si), aluminum-zirconium (Al—Zr), aluminum-vanadium (Al—V), and the like. Table 1 illustrates some target chemical compositions. The composite specimens have roughly the same weight, which is 18 grams.

TABLE 1

| Directional Solidification | |
|---|---|
| AlB5VZr1 | AlB5 wt % V5 wt % Zr15 wt % |
| AlB10VZr1 | AlB10 wt % V5 wt % Zr15 wt % |
| AlB5Zr1 | AlB5 wt % Zr15 wt % |
| AlB10Zr1 | AlB10 wt % Zr15 wt % |
| AlB5V1 | AlB5 wt % V5 wt % |
| AlB10V1 | AlB10 wt % V5 wt % |
| 1B1Cu—Al | AlB1 wt % and 1Cu wt % |
| 1B5Cu—Al | AlB1 wt % and 5Cu wt % |
| 2.5B1Cu—Al | AlB2.5 wt % and 1Cu wt % |
| 5B2.5Cu—Al | AlB5 wt % and 2.5Cu wt % |

A molten composite is deposited into the mold cast 120. Thereafter, the mold cast 120 is inserted into the furnace 105, which has been pre-heated to a specified temperature such as 850° C. The heat sink 110 is configured to draw heat from the mold cast 120. In certain embodiments, the heat sink 110 is in physical contact on a first side with the mold cast 120 and is refrigerated on a second side by the cooling source 115. The cooling source 115 cools the heat sink 110 by applying refrigerant, such as water or other cooling liquid or a cooled air, to the heat sink 110. For example, the cooling source 115 can apply a flow-controlled water jet to the second side of the heat sink 110. The flow of the water jet can be controlled by a regulator 125, such as a valve or other suitable means for controlling the amount of water (or other refrigerant) applied to the heat sink 110.

In certain embodiments, by controlling the cooling of the composite (i.e., by directing the solidification of the composite), the reinforcement particle matrix is manipulated such that particle alignment is altered from what would occur through unregulated cooling of the composite. When the composite cools in a non-regulated fashion, that is naturally or without heat augmentation, heat escapes the composite creating heat grains or heat seams. The reinforcement particles align in a uniform fashion around the heat grains. Therefore, the reinforcement particles are distributed in a uniform fashion throughout the composite. The directional solidification system 100 is configured to delay the cooling of the composite by applying heat to the composite during the cooling time. For example, the directional solidification system 100 can delay the cooling of the composite by one to ten seconds. Delaying the cooling of the composite alters the location of the heat grains, therefore altering the reinforcement particle distribution. For example, directed solidification can cause more heat grains to occur in regions further from the heat sink 115.

In certain embodiments, the directional solidification system 100 includes a plurality of thermocouples 130 connected to the furnace 105. For example, the thermocouples 130 can be coupled to the furnace 105 with at least one thermocouple 130 at a location proximate to the heat sink 110. The thermocouples 130 can be spaced 2.5 centimeters (cm) apart at different heights along the mold cast 120. The thermocouples 130 take data measurements of the cooling composite in the mold cast 120 to identify hardness, reinforcement particle distance, or both.

Equation 1 identifies hardness in the composite sample. Equation 1 is as follows:

$$N = S^2 t^2_{[\frac{a}{2},n-1]} \quad (1)$$

where N is the sample size (such as 11 measurements per micrograph); S is the standard deviation (α2 μ2); t is the t-student distribution; a,α is the maximum allowed error (such as 10%), n is measured data, and μ is a data average.

Equation 2 identifies particle distance in the composite sample. Equation 2 is as follows:

$$N = S^2 Z^2_{[\frac{a}{2},n-1]} \quad (2)$$

where N is the sample size (such as 40 measurements per micrograph); S is the standard deviation (α2 μ2); Z is the Normal distribution; a,α is the maximum allowed error (such as 10%), n is measured data, and μ is a data average.

Figure 2:
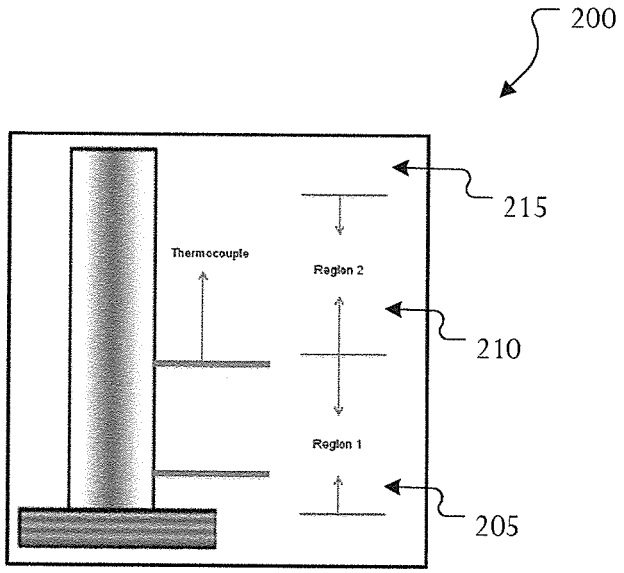
FIG. 2 illustrates sample regions for a composite sample formed using a directional solidification system according to embodiments of this disclosure.

FIG. 2 illustrates sample regions for a composite sample 200 formed using a directional solidification system according to embodiments of this disclosure. The composite sample 200 of FIG. 2 is formed using a directional solidification system, such as the directional solidification system 100. Although certain details will be provided with reference to the components of the composite sample 200 of FIG. 2, it should be understood that other embodiments may include more, less, or different components. The composite sample 200 includes a first region 205, a second region 210 and a third region 215. The first region 205 is disposed closest to the heat sink 110. The third region 215 is disposed furthest from the heat sink 110. It should be understood that illustration of three regions is for example purposes only and any number of regions could be used without departing from the scope of this disclosure.

FIGS. 3 through 6 illustrate hardness comparisons of composite regions using directional solidification according to embodiments of this disclosure. The hardness comparisons shown in FIGS. 3 through 6 are for illustration only. Other embodiments could be used without departing from the scope of this disclosure.

Figure 3:
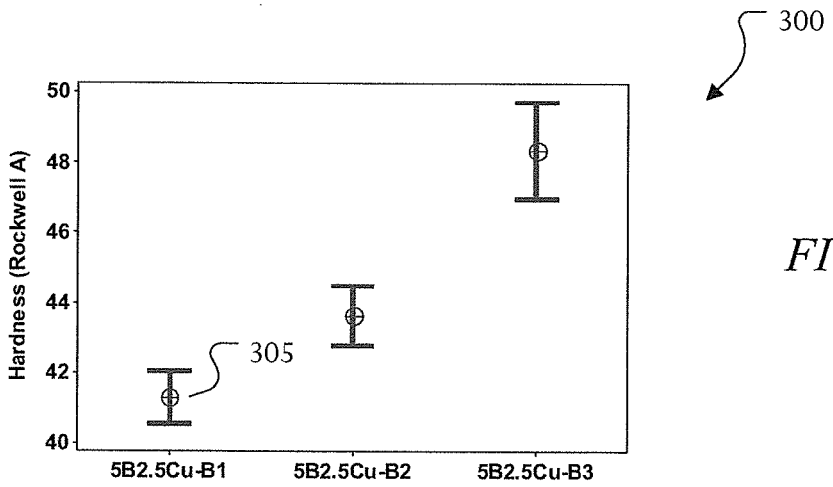
FIGS. 3 through 6 illustrate hardness comparisons of composite regions using directional solidification according to embodiments of this disclosure.

Rockwell A superficial hardness analysis 300 on AlCu-based composites, as shown in FIG. 3, shows high superficial values in samples with high boride content. Low hardness values 305 were observed at the first zone 205 nearest the heat sink 110. Low hardness values 305 occur in the first zone 205 due to a better redistribution of $Al_2Cu$ eutectic phase along the composite sample 200 (at the matrix grain boundaries) as the distance from the heat sink 110 is increased.

Figure 4:
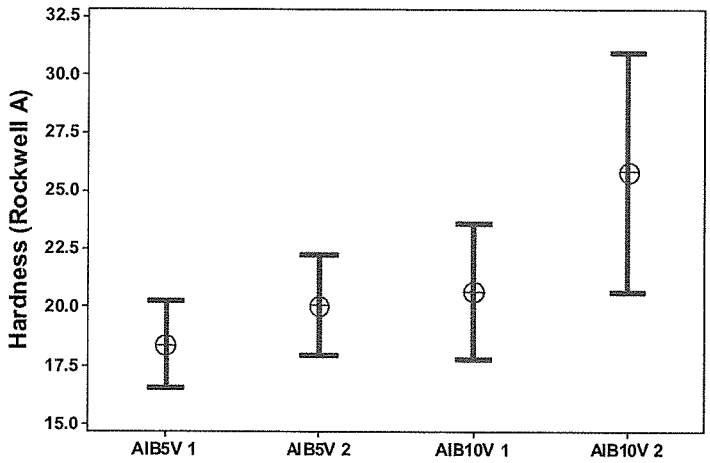

Moreover, AlV-based composites containing 5 wt % B show minor differences in superficial hardness when compared to composites containing 10 wt % B as shown in FIG. 3. Similarly, in the AlCu-based composite, the hardness values for the AlBV increased as the boride composition was increased. FIG. 4 illustrates the average hardness comparisons between two sets of Al—B—V samples containing V from 0 to 5 wt % and B from 0 to 5 and 0 to 10 wt % under directional solidification (cross-sections 1 and 2 respectively). As shown in FIG. 4, the hardness values for AlV-based composites occur away from the heat sink 110.

Figure 5:
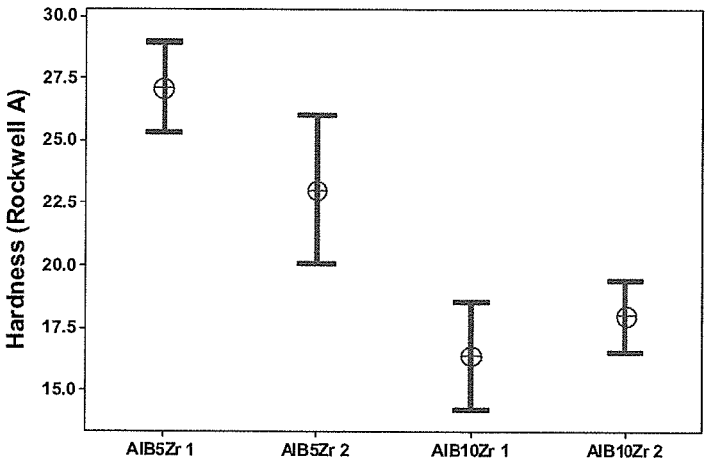

FIG. 5 illustrates the average hardness comparisons between two sets of samples Al—B—Zr containing Zr from 0 to 15 wt % and B from 0 to 5 and 0 to 10 wt % under directional solidification (cross-sections 1 and 2 respectively). Superficial hardness measurements on the AlZr-based composites also show minor differences between the cross sectional areas. Additionally, the superficial hardness of the composite decreases in zones further away from the heat sink 110. However, this behavior is reversed as higher concentrations of boride particles are present in the composite; in this latter case, the behavior is similar to the AlCu- or AlV-based composites. It should be noted that the overall superficial hardness for the AlB10Zr composite was reduced by approximately 30% when comparing samples with $AlB_2$ 5 wt % to 10 wt %.

Figure 6:
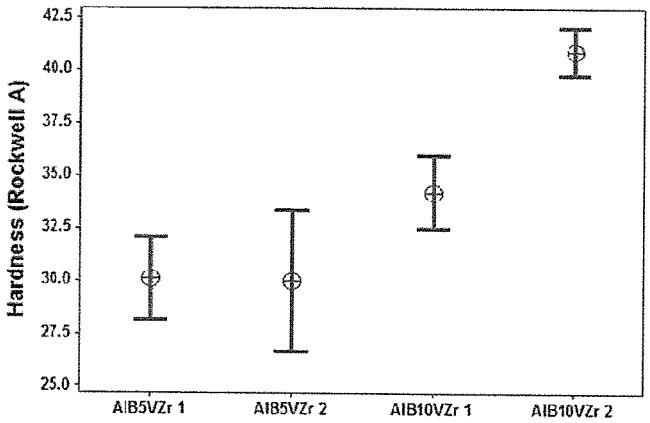

FIG. 6 illustrates the average hardness comparisons between two sets of samples Al—B—V—Zr containing V from 0 to 5 wt %, Zr from 0 to 15 wt %, and B from 0 to 5 and 0 to 10 wt % under directional solidification (cross-sections 1 and 2 respectively). The interaction between AlZr- and AlV-based composites was shown in the combination of $AlB_2$—V—Zr. Here, the superficial hardness of the high boride concentration samples nearly matches the superficial hardness of the AlBCu composite.

Figure 7:
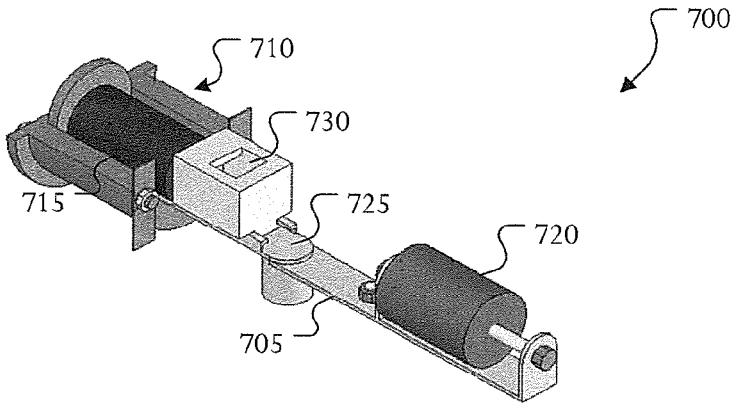
FIG. 7 illustrates a centrifugal casting system according to embodiments of this disclosure.

FIG. 7 illustrates a centrifugal casting system according to embodiments of this disclosure. The centrifugal casting system 700 of FIG. 7 is configured to cast a composite material, such as an AMC. Although certain details will be provided with reference to the components of the centrifugal casting system 700 of FIG. 7, it should be understood that other embodiments may include more, less, or different components. The centrifugal casting system 700 includes a fixture or arm 705, a transfer scoop 710, a cylindrical graphite mold 715, and a counterweight 720.

The arm 705 includes a center mounting point 725. The arm 705 is configured to hold the transfer scoop 710 at a first end and hold the counterweight 720 at the second end. The arm 705 is configured to rotate about the center mounting point 725 such that, when the arm 705 rotates, the transfer scoop 710 traverses a first circular path around the center mounting point 725. In addition, the counterweight 720 also traverses a second circular path around the center mounting point 725.

The centrifugal casting system 700 is configured to apply a centrifugal force to the composite material in the mold 715 during casting (e.g., solidification/cooling) of the composite material. The centrifugal casting system 700 can be driven by an electrical motor configured to regulate a rotational speed of the arm 705 and, consequently, the centrifugal force applied to the transfer scoop 710. For example, the motor can rotate the arm 705 at different rotational speeds, such as 300 revolutions per minute (RPM), 350 RPM, and 400 RPM. It should be understood that the illustration of the three rotational speeds is for example purposes only and the motor can rotate the arm 705 at higher or lower RPMs without departing from the scope of this disclosure. The counterweight 720 is configured to provide stability to the centrifugal casting system 700 as the motor rotates the arm 705. In certain embodiments, the centrifugal casting system 700 includes supports, such as legs, that are secured to the floor or another mounting surface in order to provide additional stability to the centrifugal casting system 700.

The transfer scoop 710 includes a window 730 or round opening. The window 730 is configured such that, when the molten composite is poured into the scoop 710, the centrifugal force applied to the molten composite forces the molten composite to fill the mold 715 along the radial direction while minimizing leakage. The composite material is melted in a furnace at a higher than melting point temperature. For example, the composite material can be melted in a conventional furnace at approximately 900° C. for Al—Si 12 wt % composites. Melting well above the melting point of the aluminum matrix is used to ensure proper flow of the molten material into the graphite mold 715. The crucible and the graphite mold 715 are preheated, such as by using an oxy-acetylene torch and a conventional furnace to approximately 700° C., respectively. Once the preheating of the crucible and graphite mold 715 is complete, the components of the centrifugal casting system 700 are assembled, and the molten composite is poured into the crucible.

Using the centrifugal casting system 700, reinforcement particles are added to a master alloy, such as aluminum-copper (Al—Cu), aluminum-silicon (Al—Si), aluminum-zirconium (Al—Zr), aluminum-vanadium (Al—V), and the like. Table 2 illustrates some target chemical compositions. The composite specimens have roughly the same weight, which is 18 grams.

TABLE 2

| Centrifugal Casting | |
|---|---|
| AlB2Si12—3C1 | AlB2 2 wt % and AlSi 12 wt % |

Figure 8:
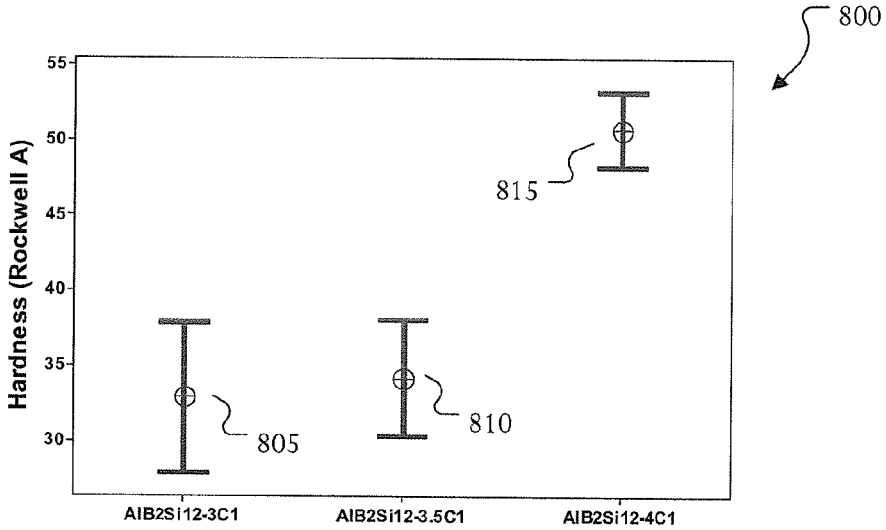
FIGS. 8 through 10 illustrate hardness comparisons of composite regions using centrifugal casting according to embodiments of this disclosure.
Figure 9:
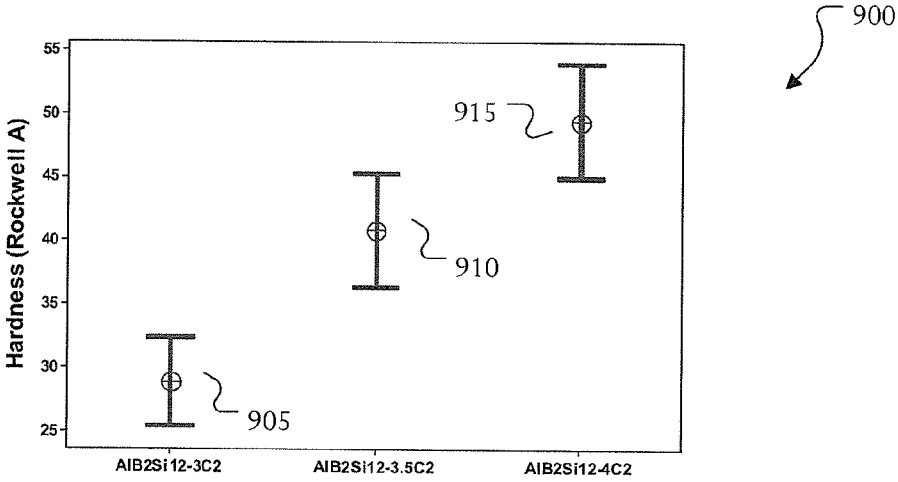
Figure 10:
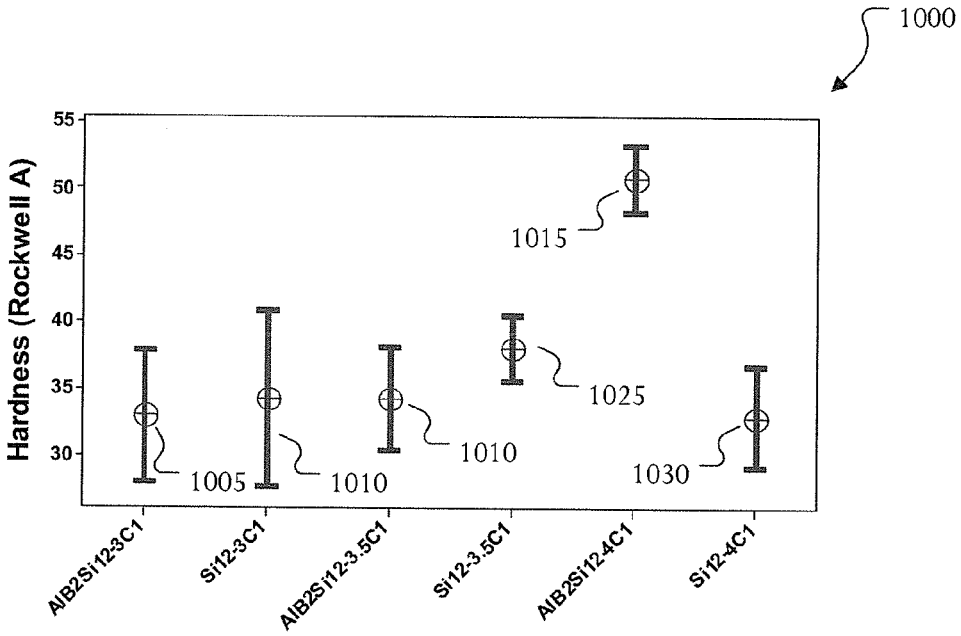

FIGS. 8 through 10 illustrate hardness comparisons of composite regions using centrifugal casting according to embodiments of this disclosure. The hardness comparisons shown in FIGS. 8 through 10 are for illustration only. Other embodiments could be used without departing from the scope of this disclosure.

Centrifugally cast samples of AlSi-based composites show a higher superficial hardness for higher rotational speeds. The relationship of the higher superficial hardness for higher rotational speeds results from the higher speeds forcing the denser boride particles to move radially to the surface of the sample. Varying the rotational speed of the arm 705 alters the reinforcement particle matrix of the composite. Accordingly, by regulating the rotational speed of the arm 705, an operator can focus areas of concentration for the reinforcement particles. Therefore, the centrifugal casting system 700 is configured to tailor properties of the composite based on design needs.

FIG. 8 illustrates the average hardness comparisons 800 between AlSi 12 wt % and B 2 wt % under centrifugal casting at 300 RPM 805, 350 RPM 810 and 400 RPM 815 for cross-section 1. FIG. 9 illustrates the average hardness comparisons 900 between AlSi 12 wt % and B 2 wt % under centrifugal casting at 300 RPM 905, 350 RPM 910 and 400 RPM 915 for cross-section 2. FIG. 10 illustrates the average hardness comparisons 900 between AlSi 12 wt % and B 2 wt % under centrifugal casting at 300 RPM 1005, 350 RPM 1010 and 400 RPM 1015 for cross-section 1 and for Si12-3.5Cl under centrifugal casting at 300 RPM 1020, 350 RPM 1025 and 400 RPM 1030 for cross-section 2.

Figure 11:
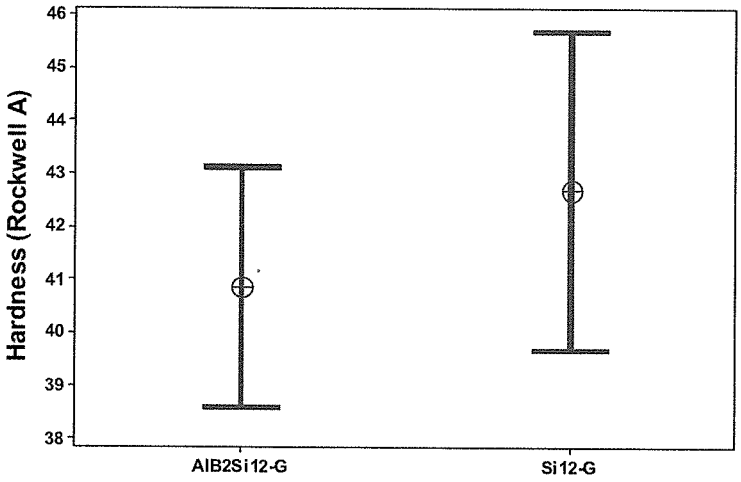
FIG. 11 illustrates average hardness comparisons between AlSi wt % and B wt % under gravity casting according to this disclosure.

In certain embodiments, a gravity cast system is used. The gravity cast samples of Al—Si 12 wt % B 2 wt % were prepared by melting the composite at 850° C. in a graphite crucible. The liquid composite was then poured into a graphite mold and allowed to cool to room temperature. FIG. 11 illustrates the average hardness comparisons 1100 between AlSi 12 wt % and B 2 wt % under gravity casting according to this disclosure. As shown in FIG. 11, the gravity cast samples show no significant increase in superficial hardness.

Table 3 illustrates some target chemical compositions for the gravity cast system. The composite specimens have roughly the same weight, which is 18 grams.

TABLE 3

| Gravity Casting | |
|---|---|
| AlB2Si12—G1 | $AlB_2$ 2 wt % and AlSi 12 wt % |

To obtain the measurements illustrated in FIGS. 3 through 6 and 8 through 11, all samples were ground and polished using a 0.05 μm SiO emulsion. In order to ensure proper cleaning, an ultrasonic cleaner was used. Once all samples were prepared, they were analyzed by optical microscope to identify the present phase as well as the distribution of the diborides in the matrix.

In addition, all samples were cross-sectioned along the longitudinal axis. Each slice was ground, polished, and etched with diluted hydrogen fluoride (HF). Thereafter, sodium hydroxide (NaOH) was used to reveal copper-containing phases. Then, the distances between the centers of each particle was analyzed.

FIGS. 12 through 17 illustrate lognormal distributions of boride inter-particle distance according to embodiments of this disclosure. The lognormal distributions shown in FIGS. 12 through 17 are for illustration only. Other embodiments could be used without departing from the scope of this disclosure.

Additional statistical analysis performed on the micrographs of the samples described above illustrate that the particle distributions showed a lognormal behavior. In an example analysis on the different samples, the different chemical compositions had no significant effect on the inter-particle spacing parameter. That is, the particle spacing was substantially the same regardless of chemical composition. The particle spacing is in the range between 5-7 μm regardless of chemical composition.

Figure 12:
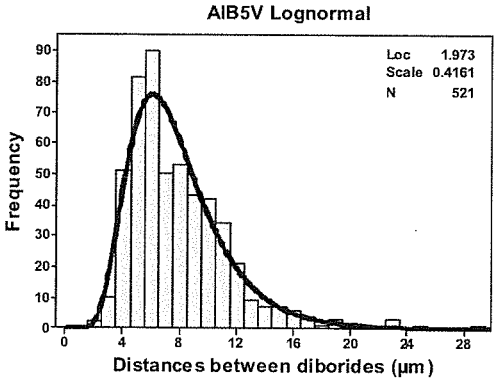
FIGS. 12 through 17 illustrate lognormal distributions of boride inter-particle distance according to embodiments of this disclosure.
Figure 13:
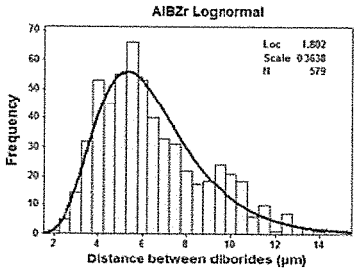
Figure 14:
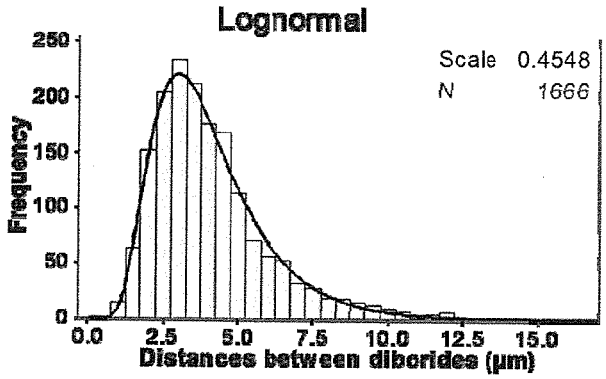
Figure 15:
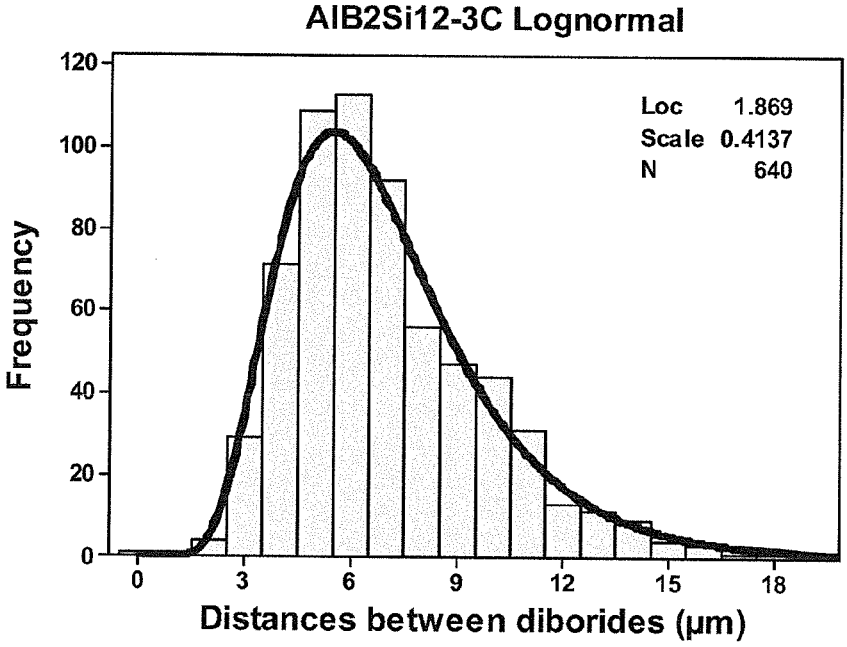
Figure 16:
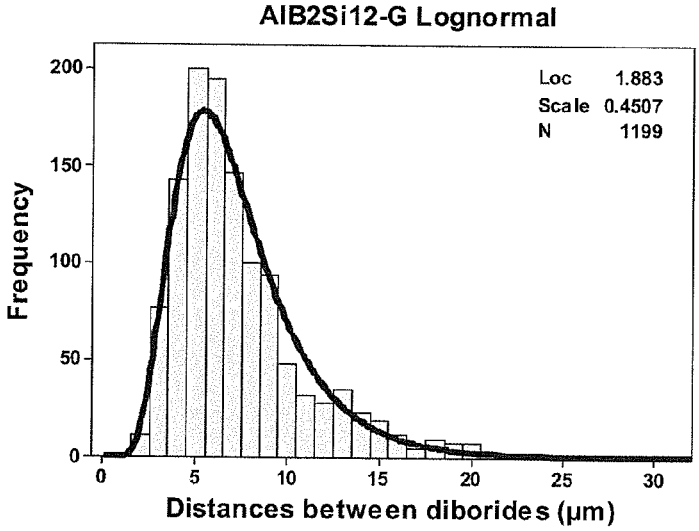
Figure 17:
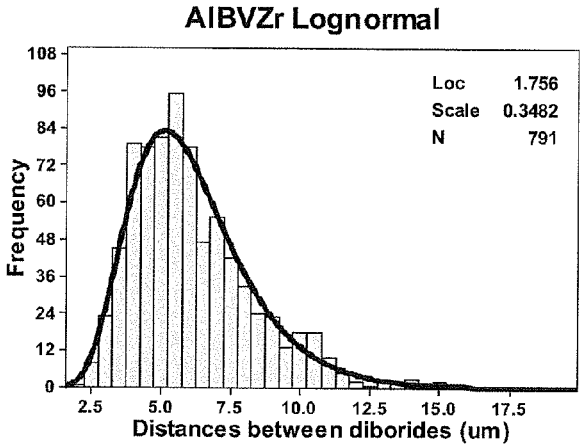

FIGS. 12 and 13 illustrate lognormal distributions of boride inter-particle distance in μm obtained on Al—B—V and Al—B Zr samples containing V from 0 to 5 wt %, Zr from 0 to 15 wt %, and B from 0 to 5 wt %. FIG. 14 illustrates lognormal distribution of boride inter-particle distance in μm obtained on Al—B—Cu samples containing 5 wt % B-2.5 wt % Cu under solid front velocities of 0.02 and 0.2 cm/s. FIG. 15 illustrates lognormal distribution of boride inter-particle distance in μm obtained on AlB2 2 wt % and AlSi 12 wt % samples under gravity casting. FIG. 16 illustrates lognormal distribution of boride inter-particle distance in μm obtained on AlB2 2 wt % and AlSi 12 wt % samples under centrifugal casting. FIG. 17 illustrates lognormal distribution of boride inter-particle distance in μm obtained on Al—B—V—Zr samples containing V from 0 to 5 wt %, Zr from 0 to 15 wt %, and B from 0 to 5 wt %.

Figure 18:
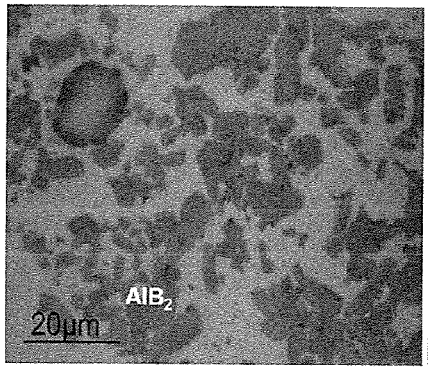
FIGS. 18 through 22 illustrate various samples according to embodiments of this disclosure.
Figure 19:
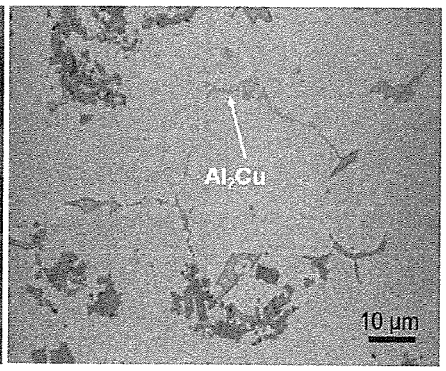
Figure 20:
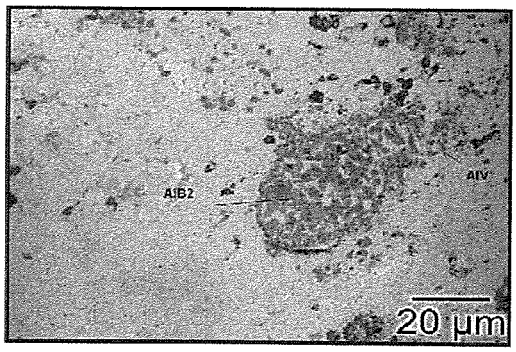
Figure 21:
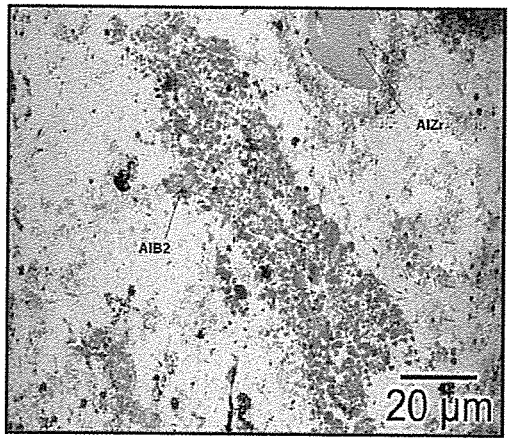
Figure 22:
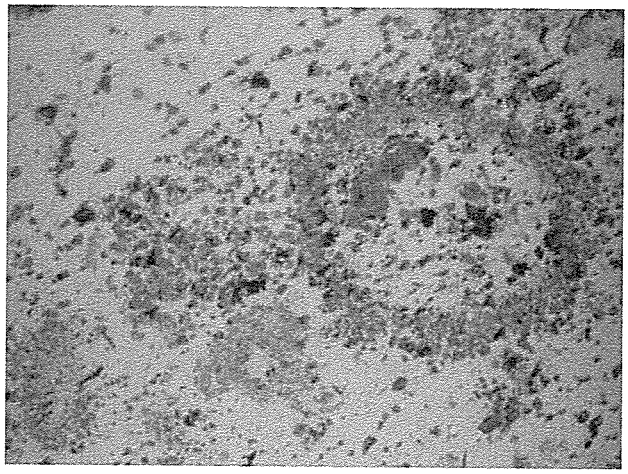

FIGS. 18 through 22 illustrate various samples according to embodiments of this disclosure. FIG. 18 illustrates a sample showing AlB2 phase at 20 μm. FIG. 19 illustrates a sample with $\vartheta$ in Al—B—Cu composite at 10 μm. FIG. 20 illustrates an optical micrograph of an Al—B—V sample at 20 μm. FIG. 21 illustrates an optical micrograph of an Al—B—Zr sample at 20 μm. FIG. 22 illustrates an optical micrograph of an Al—B—V—Zr sample at 20 μm. The samples shown in FIGS. 18 through 22 are for illustration only. Other embodiments could be used without departing from the scope of this disclosure.

In certain embodiments, a new casting method using a directional solidification or a centrifugal casting increases a superficial hardness on a composite material, such as AlBCu, by redistributing the $Al_2Cu$ phase on the matrix. The directional solidification process also enables dendritic growth of the copper $Al_2Cu$ phase within the liquid matrix. Since the dendrite growth moves normal to the heat rejection from the heat sink (chill plate), the dendrites are forced to grow in the longitudinal axis of the samples, pushing the reinforcing particles upward (away from the heat sink).

The AlBV samples for a 5 wt % $AlB_2$ lack the formation of a well-dispersed eutectic phase or the appearance of dendritic growth within the matrix. This suggests that the main hardening mechanism is related to the dispersion of the small AlV and the $AlB_2$ phases that appear randomly clustered throughout the matrix and their interaction with the dislocations.

The mechanism that explains the behavior of the AlBZr composite also indicates an interaction between the $AlB_2$ particles and the AlZr large particles. These large ceramic particles can be responsible for the overall hardness gradient across the sample. As shown in FIGS. 18-22, the samples with high hardness values show areas with large $AlZr_3$ particles. As the boride concentration was increased, the size of the particles was reduced, as was the hardness.

Centrifugal casting samples of AlBSi composites showed the highest surface hardness values from all of the samples studied. This was done by effectively pushing particles in the centrifugal direction, often creating a hardness gradient across the sample. Once the processing parameters exceed 350 RPM, a substantial portion (almost all) of the particles are disposed on the surface of the sample. In contrast, using a gravity cast system, the superficial hardness can be averaged to 42 Hardness Rockwell A (HRA). These hardness values are related to their respective inter-particle spacing parameters. In general, all samples exhibited a lognormal distribution as a result of random variables created by the processing effect. Lognormal distribution usually applies when studying changing conditions. When a master alloy was added to the $AlB_2$ and was processed, the boride particles behaved in a lognormal way.

Using a directional solidification or a centrifugal casting on the composites provides a high degree of versatility. The directional solidification system and the centrifugal casting system relocate particles within the sample, thus reducing the need to add more boride particles to increase hardness. The interaction due to the combined V+Zr effect is apparent in the AlBVZr composite in which higher superficial hardness is achieved at higher boride concentrations. In contrast, samples produced using gravity casting have no major difference in superficial hardness within their cross-sections.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A method comprising:

placing a molten composite material in a mold that is configured to hold the molten composite material; and redistributing, by a reinforcement particle unit that manipulates a reinforcement particle distribution, reinforcement particles during a solidification of the molten composite material;

wherein the reinforcement particle unit comprises a directed solidification unit; and wherein redistributing the reinforcement particles comprises:

delaying cooling of the molten composite material by a furnace configured to receive the mold;

drawing heat away from a side of the mold by a heat sink; and varying a speed at which the molten composite material cools to alter the distribution of the reinforcement particles.

2. The method of claim 1, wherein delaying the cooling of the molten composite material comprises applying a heat sufficient to delay the cooling of the molten composite material by a range of about 1 second to about 10 seconds.

3. The method of claim 1, wherein the molten composite material comprises an aluminum matrix composite.

4. The method of claim 1, wherein the furnace is pre-heated to about 850° C. prior to receiving the mold.

5. The method of claim 1, further comprising:

drawing heat away from the heat sink by a cooling source.

6. The method of claim 5, wherein the cooling source applies a flow-controlled water jet to the heat sink.

7. The method of claim 1, further comprising:

obtaining measurements of the molten composite material during the cooling of the molten composite material.

8. A method comprising:

forming a composite material comprising a specified percentage of boride particles; and controlling a redistribution of the boride particles in the composite material during a solidification of a molten composite material;

wherein controlling the redistribution of the boride particles comprises:

applying heat to the composite material to form the molten composite material;

holding, in a mold, the molten composite material; and focusing, by a reinforcement particle unit, a location of the boride particles during a cooling of the molten composite material;

wherein the reinforcement particle unit comprises a directed solidification unit; and wherein focusing the location of the boride particles comprises:

receiving, by a vertical furnace, the mold;

drawing, by a heat sink, heat away from the mold; and delaying the cooling of the molten composite material, wherein a distribution of the boride particles is altered by a speed at which the molten composite material cools.

9. The method of claim 8, wherein delaying the cooling of the molten composite material comprises applying a heat sufficient to delay the cooling of the molten composite material by a range of about 1 second to about 10 seconds.

10. The method of claim 8, wherein the molten composite material comprises an aluminum matrix composite.

11. The method of claim 8, wherein the vertical furnace is pre-heated to about 850° C. prior to receiving the mold.

12. The method of claim 8, further comprising:

drawing heat away from the heat sink by a cooling source.

13. The method of claim 12, wherein the cooling source applies a flow-controlled water jet to the heat sink.

14. The method of claim 8, further comprising:

obtaining measurements of the molten composite material during the cooling of the molten composite material.

15. A method comprising:

applying a first heat to a composite material to form a molten composite material;

holding the molten composite material in a mold during a solidification of the molten composite material; and redistributing reinforcement particles by manipulating a reinforcement particle distribution during the solidification of the molten composite material;

wherein redistributing the reinforcement particles comprises:

delaying a cooling of the molten composite material; and drawing heat away from at least one portion of the molten composite material in the mold, wherein the distribution of the reinforcement particles is altered by a speed at which the molten composite material cools.

16. The method of claim 15, wherein delaying the cooling of the molten composite material comprises applying a second heat to the molten composite material, the second heat below a melting point of the composite material and sufficient to delay the cooling of the molten composite material by a range of about 1 second to about 10 seconds.

17. The method of claim 15, wherein the molten composite material comprises an aluminum matrix composite.

18. The method of claim 15, further comprising:

drawing heat away from the mold by a heat sink; and drawing heat away from the heat sink by a cooling source.

19. The method of claim 18, wherein the cooling source applies a flow-controlled water jet to the heat sink.

20. The method of claim 15, further comprising:

obtaining measurements of the molten composite material during the cooling of the molten composite material.

* * * * *